US005598892A

United States Patent [19]

Fox

[11] Patent Number: 5,598,892

[45] Date of Patent: Feb. 4, 1997

[54] TOOL EXTENDER

[75] Inventor: Morton H. Fox, Covina, Calif.

[73] Assignee: Marilyn S. Fox, Covina, Calif.

[21] Appl. No.: 494,406

[22] Filed: Jun. 26, 1995

[51] Int. Cl.[6] ..... B27C 3/08; B25F 5/02

[52] U.S. Cl. ..... 173/170; 408/712; 30/296.1

[58] Field of Search ..... 173/170, 171, 173/36, 31, 32, 34; 30/296.1; 408/712, 99, 100, 110, 112, 136

[56] References Cited

U.S. PATENT DOCUMENTS

| | | | |
|---|---|---|---|
| 2,989,334 | 6/1961 | Browne . | |
| 2,997,900 | 8/1961 | Pugsley . | |
| 3,060,769 | 10/1962 | Heider | 408/712 |
| 3,552,239 | 1/1971 | Yeaman et al. | 408/136 |
| 3,949,817 | 4/1976 | Rice . | |
| 4,147,220 | 4/1979 | Swiderski, Jr. et al. | 173/170 |
| 4,153,193 | 5/1979 | Urbanowicz . | |
| 4,179,805 | 12/1979 | Yamada . | |
| 4,349,301 | 9/1982 | Boyajian . | |
| 4,736,804 | 4/1988 | Geibel | 173/30 |
| 4,996,773 | 3/1991 | Albertson | 30/296.1 |
| 5,361,851 | 11/1994 | Fox . | |

*Primary Examiner*—Scott A. Smith

*Attorney, Agent, or Firm*—Boniard I. Brown

[57] ABSTRACT

A tool extender to bridge the space between a person and a portable tool to be remotely actuated by the person includes cradle means engageable with the tool and at least one guide rod attached to the cradle means and slidable within a bridge support. A strap is attached to the bridge support and is adjustable to engage a handle of the tool, whereby the strap and cradle means jointly support the tool. A mount, such as a shoulder mount, arm mount, elbow mount, or the like is attached to an elongated arm structure which extends to the bridge support. A trigger actuation mechanism includes a cord which extends from a grip element, along the elongated arm structure, to a hook engageable with a tool trigger. The trigger actuation mechanism is operable by manual squeezing of the grip element toward the mount and away from the hook. The guide rods, cord, and strap are adjustable for accommodating various sized tools. A handle is removably attached to the elongated arm structure. The elongated arm structure of the tool extender may include a first arm structure, a second arm structure, and a pivotal connection attached therebetween, enabling one of the arm structures to be inclined at an angle with respect to the other of the arm structures. The pivotal connection and adjustable handle provide for various positioning of the tool extender with respect to a workpiece and operator of the tool.

25 Claims, 3 Drawing Sheets

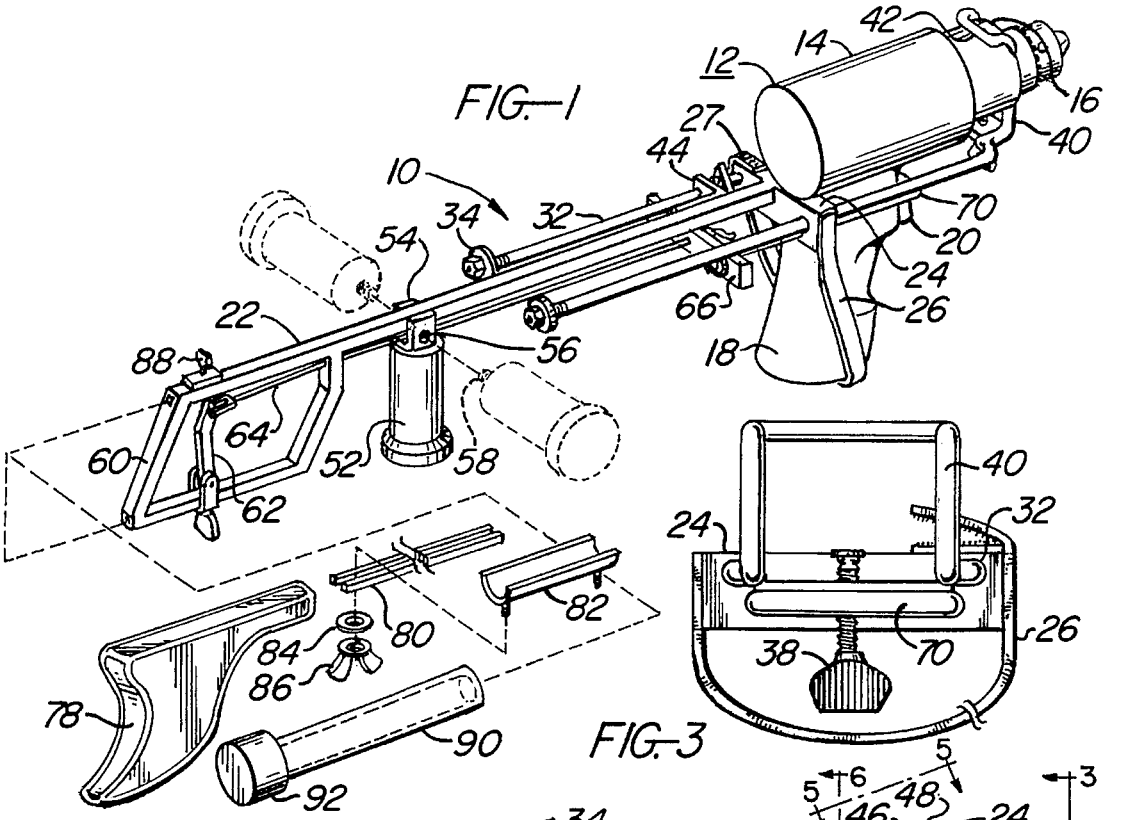
FIG.—1
FIG.—3
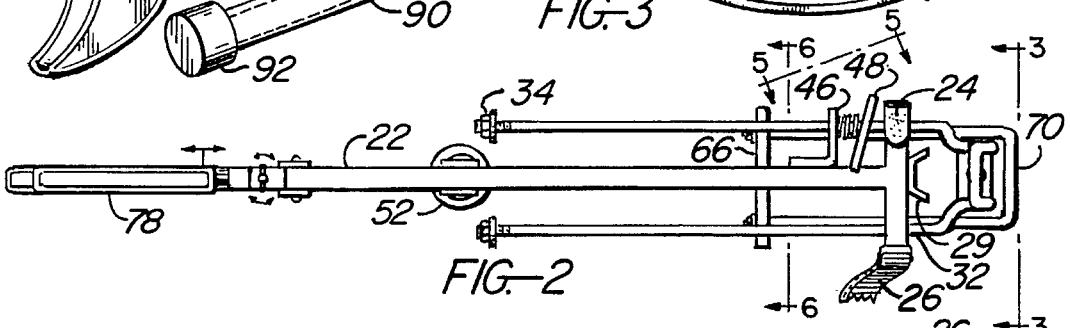
FIG.—2
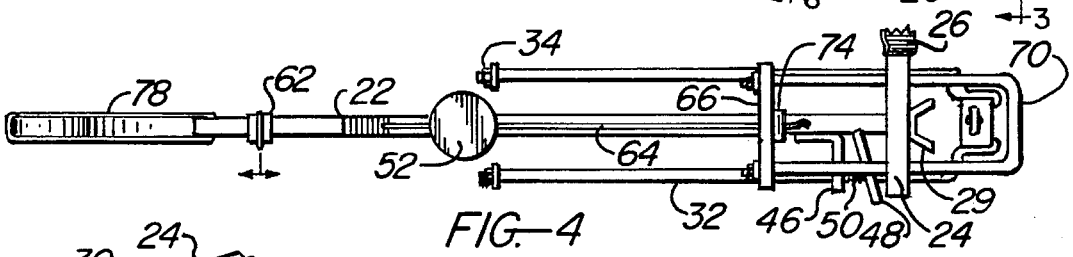
FIG.—4
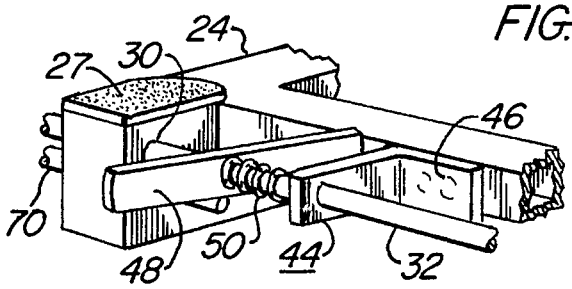
FIG.—5
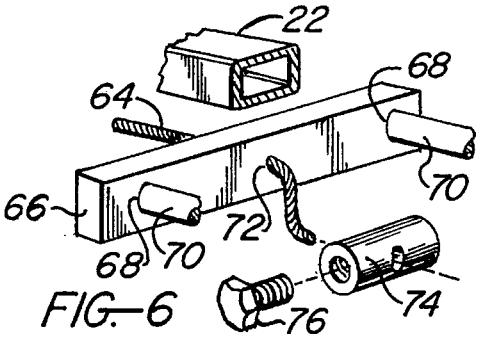
FIG.—6

TOOL EXTENDER

BACKGROUND OF THE INVENTION

The invention relates to devices for extending the reach of a person operating a hand tool and, more particularly, to the use of caulking guns, gluing guns, power drills, explosive-actuated rivet and fastener insertion tools.

Persons whose jobs include using portable hand-operated tools are sometimes required to use these tools at arms length because of difficulties in getting closer to a workpiece. Often, the workpiece may be beyond the persons reach. The operator then has several choices, including skipping the operation which is out of reach, assuming a risk of personal injury, or fabricating or otherwise providing some means to get closer to the workpiece. These situations result either in lowered quality of workmanship, unnecessary stress and/or possible injury to the operator, or lost time and additional work until means are provided to reach the objective with the required tool.

As an example, caulking, sealing or gluing often make use of an apparatus known as a caulking gun. A tube of either caulking compound, other sealant or adhesive is loaded into the caulking gun, positioned by the operator, and the contents of the tube ejected as a trigger is squeezed to cause a plunger to be advanced into the back of the tube to eject the tube's contents. This apparatus functions well as long as the object to which the tube's contents are to be applied is within the operator's reach while holding the gun.

However, the ejection nozzle must be positioned in near proximity to the work surface. When the operator is too far from the work surface, the caulking gun cannot be operated in the desired manner. Similar problems exist with respect to other tools, such as gluing guns, power drills, and rivet and fastener insertion tools.

Reach extender devices usable with various tools have been proposed. U.S. Pat. No. 5,361,851 to Fox discloses a tool reach extender which includes a saddle member and cradle which cooperatively grip and support a tool. An elongated actuator rod, hook and grip element enable the tool trigger to be remotely operated. An arm band helps a person support the tool reach extender and the tool while operating the tool.

U.S. Pat. No. 4,179,805 to Yamada discloses a portable power operated tool including an elongated tubular housing, a fixing element for receiving an operator's arm, and a handle.

U.S. Pat. No. 4,153,193 to Urbanowicz discloses a pole extender device having a hollow saddle member at one end of a pole to seat against the shoulder portion of a powder-actuated tool. The tool is retained on the saddle member by means of a set screw. The saddle member has a guide bore therein for a plunger that carries a trigger-actuator bar. A cable extends from the plunger within the pole to a rotary actuator at the remote end of the pole. The rotary actuator can be turned about the pole axis to remotely operate the tool trigger. A handle is twistably mounted on an elongate body.

U.S. Pat. No. 3,949,817 to Rice discloses a chain saw extender including an elongated post, a pivotable lever attached to the post for contacting and depressing the trigger of the chain saw, a finger operated control trigger, and means for connecting the pivotable lever and the control trigger for operating the chain saw.

U.S. Pat. No. 2,989,334 to Browne shows a device for remotely grasping and lifting a can or bottle. The device comprises an arm rest extending from an actuator handle to underlie the forearm of a person. A circular ring element is adapted to encircle the person's arm to partially support the weight of the can or bottle at the other end of the device.

Most prior art devices are intended for use with a specific type of tool, e.g., a caulking gun or a power drill or a riveting tool, and are not designed for interchangeable use with different types of tools or differently sized tool, e.g., a caulking gun and a power drill.

The present invention contemplates a tool extender device usable with different types of tools and different sized tools, e.g., a relatively short power drill or a relatively long caulking gun having an elongated trigger.

Another shortcoming of the prior art devices is that they have often required specially modified tools or special tool configurations to operatively attach the extender device to the tool. The tool extender device of the present invention is attachable to a range of different tools without modification of the tool or special tool body configuration. The device of the invention is designed to fit a variety of differently sized tools, e.g., caulking guns, explosive-actuated and power tools.

Also, the tool extender of the present invention may be bent at an angle using the tool around a corner or other obstacle preventing direct access to the workpiece. The device of the invention is designed to have interchangable mounts for enabling the tool extender to be supported on a shoulder, under an arm, or on an arm of a person operating the tool, allowing a heavier load or tool to be lifted.

SUMMARY OF THE INVENTION

A specific embodiment of the invention comprises a tool extender adapted to bridge the space between a person and a tool to be remotely actuated by the person. The tool extender for a portable tool having a body with a front nose portion, a handle and a trigger includes cradle means engageable with the front nose portion of the tool body and at least one guide rod rigidly attached to the cradle means and extending from the cradle means for positioning under the tool body. A bridge support is slidable on the guide rod and adjustable toward or away from the cradle means. A strap is attached to the bridge support and adjustable to engage the handle of the tool, whereby the strap and cradle means jointly support the tool. An elongated arm structure extends from the bridge support and a mount is attached to the elongated arm structure remote from the bridge support. A trigger actuation mechanism extends along the elongated arm structure, has a hook engageable with the tool trigger, and a grip element proximate to the mount. The trigger actuation mechanism is operable by manual squeezing of the grip element toward the mount and away from the hook.

The tool extender may further include an adjustable handle removably attached to the elongated arm structure between the bridge support and the grip element. The strap may be constructed of a flexible material including VELCRO patches and may be attached to a bra cup engageable with the handle of the tool. The mount may be a shoulder type mount, under the arm mount, or elbow mount. The hook may include an elongated portion engageable with the trigger of the tool for accommodating various sized tools. The elongated arm structure of the tool extender may include a first arm structure, a second arm structure, and a pivotal connection attached therebetween enabling one of the arm structures to be inclined at an angle with respect to the other of the arm structures. To accommodate the angled configuration of the tool extender, the trigger actuation mechanism may further include a cord extending between the hook and the grip element to be generally parallel to the elongated arm structure and a fastener removably attached to the cord for adjustably securing the cord at a desired length to enable remote actuation of the trigger of the tool.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

FIG. 1 is a perspective view of a reach extender with a power drill supported therein;

FIG. 2 is a plan view of the reach extender;

FIG. 3 is a view taken along line 3—3 of FIG. 2;

FIG. 4 is a bottom view of the reach extender;

FIG. 5 is a view taken along line 5—5 of FIG. 2;

FIG. 6 is a view taken along line 6—6 of FIG. 2;

DESCRIPTION OF THE PREFERRED EMBODIMENT

Figure 7:
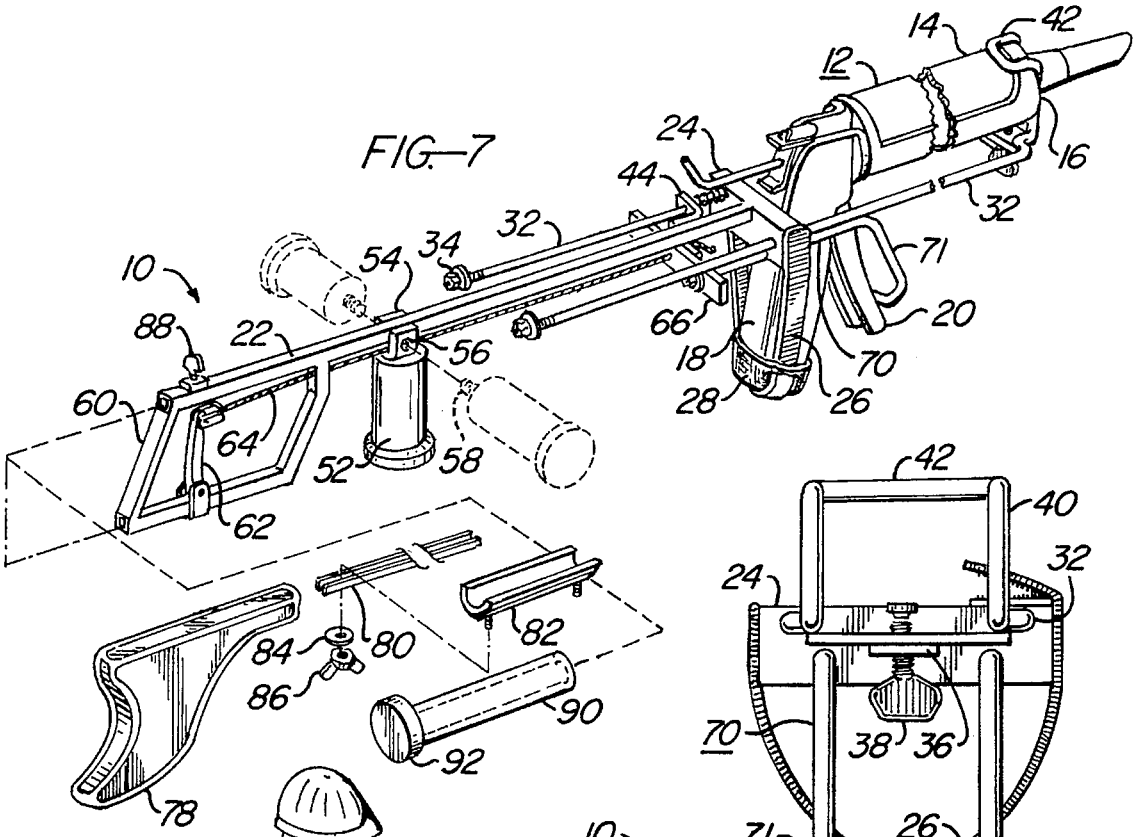
FIG. 7 is a perspective view of the reach extender with a caulking gun supported therein.

Referring to FIG. 1, a tool extender 10 supports a tool 12, such as a power drill having a tool body 14 including a front nose 16 and a handle 18. A trigger 20 projects forwardly from the handle 18.

The tool extender 10 includes an elongated arm structure 22 which connects to a bridge support 24. A strap 26 having end portions faced with fibrous adhesive patches 27 marketed under the tradename VELCRO is attached to the bridge support 24 for supporting the handle 18 of the tool 12. Utilization of the strap 26 having VELCRO enables the strap 26 to be adjusted for various size tools 12 and various size and positions of the handle grips 18. Referring to FIG. 7, the strap 26 may have a bra cup 28 to engage and hold a corner of the tool handle 18.

Figure 15:
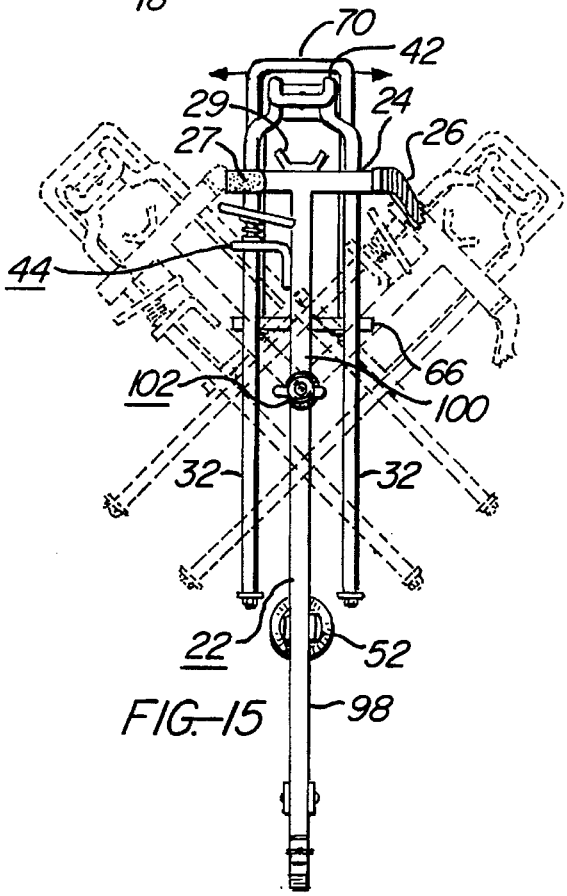
FIG. 15 is a plan view of the reach extender of FIG. 13.

Referring to FIGS. 2, 4 and 15, a groove or V-shaped element 29 is attached to the bridge support 24 for accommodating different tools or drill motors of different shapes and widths. For wide tools, the V-shaped element 29 must be wide enough to house the tool, but sized so that the space between the tool and the V-shaped element 29 is minimal to reduce movement of the tool. The V-shaped element 29 fits on the tool handle or the back of the grip of the drill motor, for example, as a fork which the tool grip or handle backs into. The taper or V-shape prevents the drill motor or tool from sliding left or right and keeps the tool centered.

The bridge support 24 has two holes 30 therethrough for receiving a cradle means. The cradle means includes two parallel guide rods 32. Each guide rod 32 is of circular cross-section, whereby the rods can extend through the circular guide holes 30 formed in the bridge support 24. The ends of the guide rods 32 have a retaining means 34, such as a nut and washer, for preventing the ends of the guide rods 32 from passing through the holes 30. A forward portion of the guide rods 32 extend horizontally to form a platform for a flat rectangular nut 36 that spans the two rods. The nut 36 is welded to the guide rods 32 to threadably support a clamp screw 38 adapted to engage the undersurface of the tool body 14. The cradle means further includes two parallel upstanding abutment bars 40 which extend upwardly frown the front ends of the guide rods 32 for abutting engagement with a front surface of the tool body nose 16. The abutment bars 40 are spaced far enough apart to have a desired clearance relative to the tool 12.

The upper ends of the abutment bars 40 are connected by a U-shaped bridge bar 42 which overlies an upper surface of the tool body 14 so that when the clamp screw 38 is turned in the clamp direction, the nose portion 16 of the tool 12 is clamped between the U-shaped bridge bar 42 and the clamp screw 38. The stroke of the clamp screw 38 is such that tool bodies having a range of different diameter nose portions can be effectively held by the defined cradle means. The guide rods 32, the abutment bars 40, and the U-shaped bridge bar 42 are preferably formed integrally from a single elongated rod which is bent at spaced points therealong to form the rod-like components 32, 40 and 42.

The strap 26 and the cradle means cooperatively support the tool 12 without drilling any holes in the tool body or otherwise modifying the tool body. Various different types of tools may be supported. FIG. 1 shows the tool extender 10 supporting a power drill. FIG. 7 shows the same tool extender 10 supporting a caulking gun. Differently sized tools will require adjustment of the strap 26 and slidable adjustment of the guide rods 32 to different locations on the bridge support 24. An adjustment length of at least six inches is preferred.

Referring to FIGS. 2 and 5, the guide rods 32 may be locked in a selected position by adjusting the securement mechanism 44 attached to the elongated arm structure 22. The securement mechanism 44 includes a stationary member 46, a movable member 48, and a spring 50 positioned therebetween. The stationary member 46 and the movable member 48 have a hole sized and adapted to receive one of the guide rods 32. Manipulation of the movable member 48 toward the stationary member 46 compresses the spring 50 and aligns the holes or the movable and stationary members 48 and 46, enabling the guide rods 32 to be slid through the holes of the movable and stationary members 48 and 46 and to be slid through the hole 30 of the bridge support 24 for adjustment of the cradle means.

A handle 52 is attached to the elongated arm structure 22 and is mounted to extend toward either side of the elongated arm structure 22 or toward the ground. The handle 52 is attached to a bracket 54 having a plurality of threaded holes 56 engagable with a threaded portion 58 of the handle 52. The handle 52 may be threaded into any of the holes 56 of the bracket 54 for altering the position of the handle 52 with respect to the elongated arm structure 22. Alternatively, the handle 52 may be pivotally attached to a bracket or to the elongated arm structure 22 for varying the position of the handle 52 without requiring that the handle 52 be unthreaded from the tool extender 10.

The tool trigger 20 is remotely actuated by a trigger actuation mechanism including a reinforcing structure 60, a manual grip element 62, a cord or line 64, a support member 66 having a plurality of holes 68, and a hook 70. The reinforcing structure 60 is attached to or integrally formed with the elongated arm structure 22. Attached to the reinforcing structure 60 is the manual grip element 62 which is slidable or pivotable within the reinforcing structure 60. The manual grip element 62 is attached to the cord 64 which extends generally parallel to the elongated arm structure 22 to the support member 66.

Figure 9:
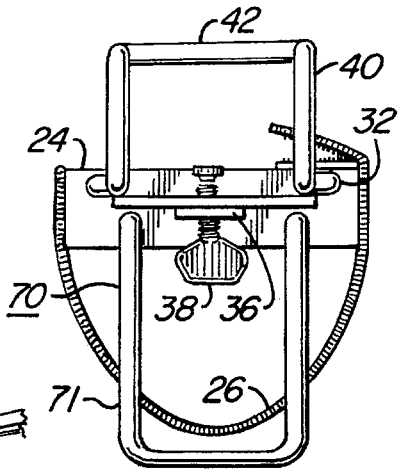
FIG. 9 is a front view of the reach extender of FIG. 7.

Referring to FIG. 6, the support member 66 has two holes 68 for receiving the ends of the hook 70 which is engagable with the trigger 20 of the tool 12. Referring to FIGS. 7 and 9, the hook 70 may be interchangable with a hook having an elongated portion 71 for contacting the trigger 20 of the tool 12, such as the trigger of a caulking gun. The ends of the hook 70 may be attached to the support member 66 by mechanical means, such as a nut and washer positioned on an opposite side of the support member 66 as compared to the position or the hook 70 or by welding the hook 70 to the support member 66.

Referring again to FIG. 6, the support member 66 has another hole 72 positioned between the holes 68 for receiving the cord 64 therethrough. The cord 64 is secured in a desired position by a fastener, such as a threaded tubular member 74 and a bolt 76. The threaded member 74 has a bore partially therethrough and by threading the bolt 76 into the tubular member 74, the cord 64 is clamped between a closed end of the tubular member 74 and the bolt 76. Alternatively, any fastener may be used to prevent the cord 64 from pulling back through the support bar 66, such as a spring-loaded cord clamp, square cross-sectioned threaded member, or the like. Different sized tools will have their triggers 20 spaced different distances from the tool nose portions 16. When the tool 12 is supported against the cradle means, the trigger will have a different spacing from the grip element 62, depending upon the size of the tool. Therefore, it is necessary that the cord 64 have an adjustable length according to variations in spacing of the tool trigger from the grip element 62.

To remotely actuate the trigger 20 of the tool 12, a person can simultaneously have one hand extending about the handle 52 and another hand about the grip element 62. By exerting squeezing force on the grip element 62, the cord 64 is moved, which moves the support bar 66, which moves the hook 70 to actuate the trigger 20 of the tool 12.

Referring to FIGS. 1, 7, 8, 8*a* and 10, a mount, such as a shoulder mount, elbow mount, mount supported under the arm or armpit of a person, or the like, is attached to the elongated arm structure 22. As an example, a shoulder butt 78 may be attached to an extended member 80 having at least one hole, a clasp 82 having a threaded portion, a washer 84, and a wing nut 86. The extended member 80 is attached to the elongated arm structure 22 by engaging a securement member 88 and may be adjustable for varying the space between the grip element 62 and the end of the shoulder butt 78 for accommodating different sized persons. The shoulder butt 78 is secured to the extended member 80 by sliding the shoulder butt 78 onto the extended member 80, disposing each threaded portion of the clasp 82 into each hole of the extended member 80, and threading the wing nut 86 onto the threaded portion extending therethrough. Alternatively, the shoulder butt 78 may be attached directly to the elongated arm structure 22.

For the various embodiments of this invention, the same reference characters will be used to designate like parts. In addition, like functions and like interactions of the parts among the various embodiments of this invention will not be repeated For each embodiment.

Figure 8:
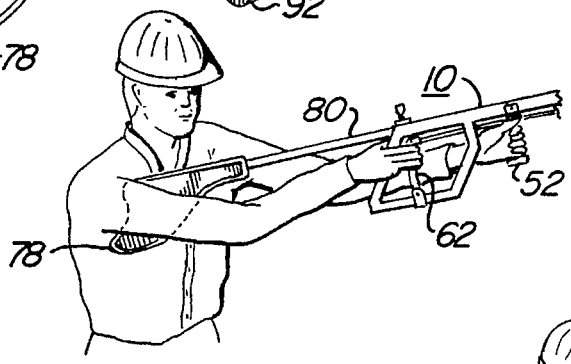
FIG. 8 is a view of the reach extender being supported on a shoulder of a person.
Figure 8A:
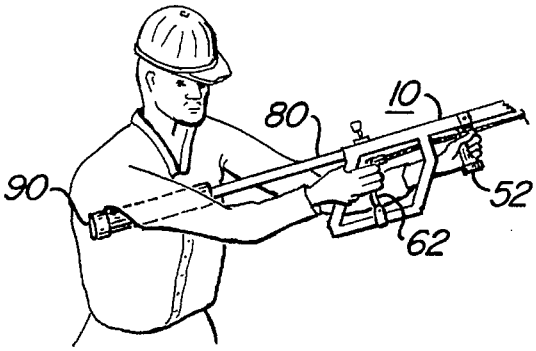
FIG. 8*a* is a view of an alternative embodiment of a mount of the reach extender being supported under an arm of a person.
Figure 10:
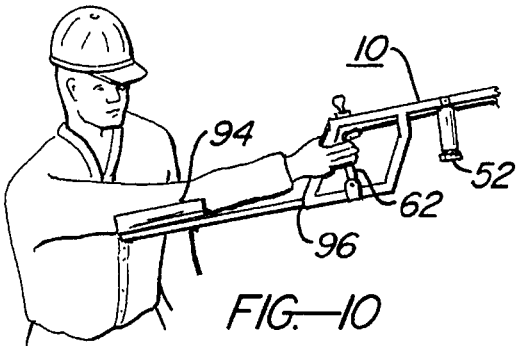
FIG. 10 is a view of another alternative embodiment of the mount of the reach extender being supported by an elbow of a person.
Figure 11:
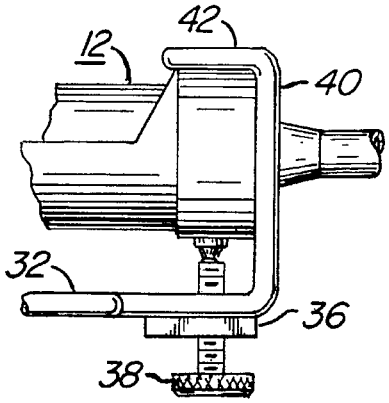
FIG. 11 is a fragmentary view of the caulking gun supported within a cradle means of the reach extender.
Figure 12:
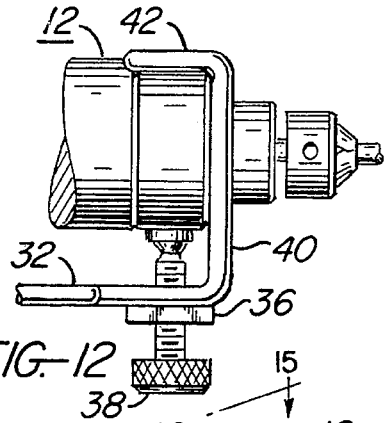
FIG. 12 is a fragmentary view of the power drill supported within the cradle means of the reach extender.

Referring to FIGS. 1, 7 and 8*a*, an alternative to the shoulder butt 78 is a mount 90 having an enlarged portion 92 for positioning under an armpit of a person or on a person's shoulder. Referring to FIG. 10, a further alternative is an elbow mount 94 having means for securing the elbow mount 94 to a person's elbow or arm, such as a curved rigid member, VELCRO straps, or the like. The elbow mount 94 is preferably attached at a bottom edge 96 of the reinforcing structure 60 for aligning a person's hand with the grip element 62.

The shoulder butt 78, mount 90, and elbow mount 94 are removable and interchangeable for providing different supports of the tool extender 10. Supporting the tool extender 10 under a person's armpit or at the shoulder enables the user to lift a heavier load or tool at the far end of the tool extender 10.

Figure 13:
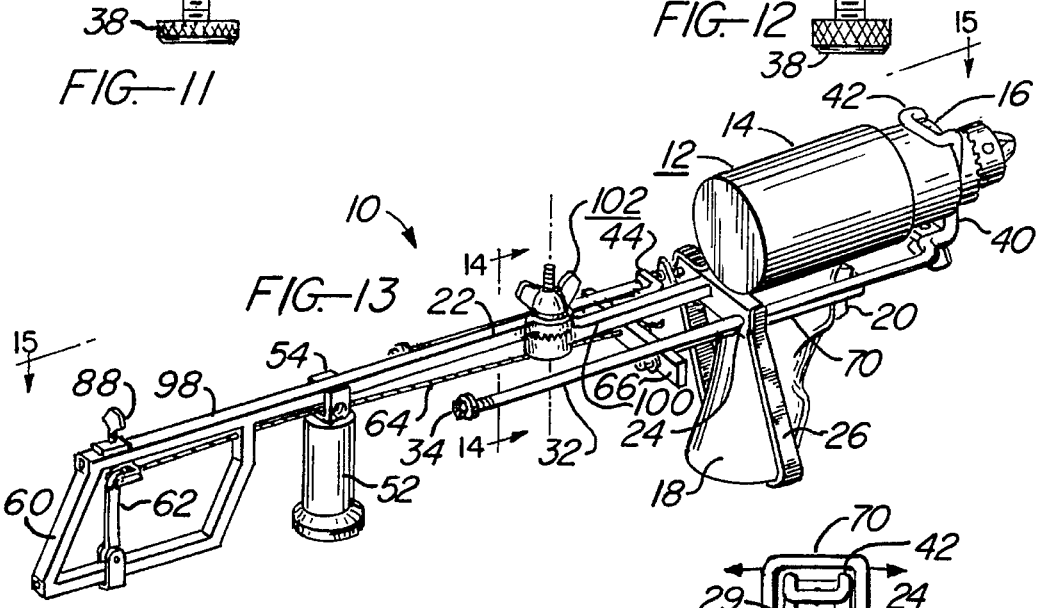
FIG. 13 is an alternative embodiment of the reach extender.
Figure 14:
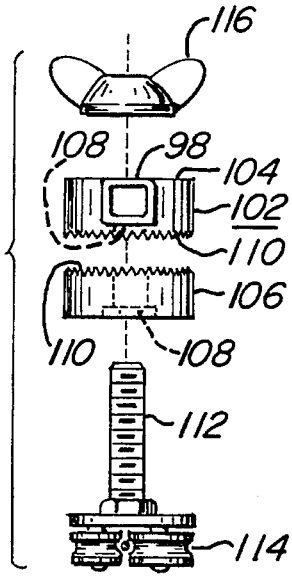
FIG. 14 is an exploded view taken along line 14—14 of FIG. 13.

Referring to FIGS. 13–15, as an alternative, the elongated arm structure 22 may be formed of a first arm structure 98, a second arm structure 100, and a pivotal connection positioned therebetween. The first arm structure 98 and the second arm structure 100 may be pivotally attached together for enabling the tool extender 10 to be inclined to a variety of angles, such as 90°, for using the tool 12 around a corner. As one example of the pivotal connection, a sprag clutch 102 may be used to attach the first and second arm structures 98 and 100 together. The sprag clutch 102 includes a first toothed member 104 attached to the first arm structure 98 and a second toothed member 106 attached to the second arm structure 100, such as by welding or integrally formed therewith. The first and second teeth members 104 and 106 each have a bore 108 therethrough and a tooth portion 110 which mates with a toothed portion of the other toothed member. The sprag clutch 102 further includes a threaded bolt 112 having at least one pulley 114 attached to a head of the bolt 112 for directing the cord 64 of the tool extender 10. The bolt 112 is disposed within the bores 108 of the first and second toothed members 104 and 106 and is threaded into a wing nut 116 for securing the first and second arm structures 98 and 100 together.

To operate the tool extender 10, the front nose 16 of the tool 12 is positioned within the cradle means and the strap 26 is tightened around the handle 18 of the tool 12. The guide rods 32 are adjusted by manipulating the securement mechanism 44 and the clamp screw 38 is tightened to firmly hold the tool 12 in a desired position. To accommodate various size tools, the fastener is adjusted to alter the length of the cord 64 for positioning the hook 70 around the trigger 20 of the tool 12. To use the tool extender 10 in an angled location, a portion of the elongated arm structure may be pivoted to bend the tool extender 10, the cord 64 is positioned around a pulley 114, and the position of the handle 52 may be altered to comfortably and safety enable operation of the tool 12 by a person.

An advantage of the tool extender 10 is that the tool 12 may be safely and efficiently operated while a person is positioned a distance from the workpiece. Utilization of the shoulder butt 78 or mount 90 enables a heavier load or tool to be lifted and used for longer periods of time by a person. The pivotal movement of the tool extender 10 allows the tool extender 10 to be safely used for a broader variety of applications. The adjustable strap 26 facilitates the use of different tools 12 in the tool extender 10 without having to modify the tool 12.

Thus there has been shown and described a novel tool extender which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. A tool extender for a portable tool having a body with a front nose portion, a handle and a trigger, said tool extender comprising:

cradle means engageable with said front nose portion of said tool body;

at least one guide rod rigidly attached to said cradle means and extending from said cradle means for positioning under said tool body;

a bridge support slidable on said at least one guide rod and adjustable toward or away from said cradle means;

a strap attached to said bridge support and adjustable to engage said handle of said tool, whereby said strap and cradle means jointly support said tool;

an elongated arm structure extending from said bridge support;

a mount attached to said elongated arm structure remote from said bridge support; and a trigger actuation mechanism extending along said elongated arm structure and having a hook engageable with said tool trigger, and a grip element proximate to said mount, said trigger actuation mechanism being operable by manual squeezing of said grip element toward said mount and away from said hook.

2. The tool extender according to claim 1, further comprising an adjustable handle removably attached to said elongated arm structure between said bridge support and said grip element.

3. The tool extender according to claim 2, further comprising a bracket attached to said elongated arm structure and having a plurality of threaded holes engageable with said handle for enabling adjustment of the positioning of said handle with respect to said elongated arm structure.

4. The tool extender according to claim 1, wherein said mount is a shoulder butt for contacting a shoulder of a person during use of said tool.

5. The tool extender according to claim 1, wherein said mount includes an enlarged portion for providing underarm support to a person during use of said tool.

6. The tool extender according to claim 1, wherein said mount is an elbow mount for providing support to a person during use of said tool.

7. The tool extender according to claim 1, wherein said trigger actuation mechanism further comprises:

a line extending between said hook and said grip element to be generally parallel to said elongated arm structure; and a fastener removably attached to said line for adjustably securing said cord at a desired length to enable remote actuation of said trigger of said tool.

8. The tool extender according to claim 7, wherein said fastener comprises:

a tubular member having a hole for receiving said cord and a threaded bore; and a bolt receivable in said threaded bore of said tubular member for retaining said cord in a desired position.

9. The tool extender according to claim 7, further comprising a support bar attached to said hook and having a hole sized and adapted to receive said cord.

10. The tool extender according to claim 1, wherein said hook includes an elongated portion engageable with said trigger of said tool for accommodating various sized tools.

11. The tool extender according to claim 1, further comprising a securement mechanism attached to said elongated arm structure and engageable with said at least one guide rod for securing said position of said at least one guide rod with respect to said tool.

12. The tool extender according to claim 11, wherein said bridge support has a hole for receiving each end of said at least one guide rod, said securement mechanism comprising:

a stationary member attached to said elongated arm structure and having a hole substantially aligned with said hole of said bridge support;

a movable member pivotally attached to said elongated arm structure and having a hole substantially aligned with said holes of said bridge support and said stationary member in a first position for allowing movement of said at least one guide rod through said hole of said bridge support and not aligned with said holes of said bridge support and said stationary member in a second position for preventing movement or said at least one guide rod through said hole or said bridge support for adjustment of said at least one guide rod with respect to said tool; and a spring positioned between said stationary member and said movable member for retaining said stationary member and said movable member in spaced apart relation.

13. The tool extender according to claim 1, wherein said strap is constructed of a flexible material and includes a fibrous adhesive patch mateably engageable with a fibrous adhesive patch attached to said bridge support.

14. The tool extender according to claim 1, wherein said strap includes a bra cup engageable with said handle of said tool.

15. The tool extender according to claim 1, further comprising a reinforcing structure attached to an underside of said elongated arm structure.

16. The tool extender according to claim 1, further comprising an extended member attached between said elongated member and said mount for providing adjustment of the distance between said grip element and said mount.

17. The tool extender according to claim 1, wherein:

said elongated arm structure includes a first arm structure and a second arm structure, and further including, a pivotal connection attached to said first arm structure and to said second arm structure enabling one of said first and second arm structures to be inclined at an angle with respect to the other of said first and second arm structures.

18. The tool extender according to claim 17, wherein:

said pivotal connection includes said first arm structure attached to a first tooth member and having a bore therethrough and said second arm structure attached to a second tooth member and having a bore therethrough, said first and second tooth members engageable with one another for pivotally securing together said first and second arm structures;

a bolt disposed within said bores of said first and second arm structures and having a pulley for guiding said cord; and a nut threadably attached to said bolt for securing together said first and second arm structures of said elongated arm structure.

19. The tool extender according to claim 1, wherein:

said cradle means comprises two spaced parallel abutment bars extending upwardly from said guide rods to engage said tool body nose portion, and further including a bridge bar connecting said abutment bars, and a screw clamp supported by said at least one guide rod in proximity to said abutment bars, said clamp screw having a rotational axis parallel to said abutment bars, whereby said tool body nose is clamped between said bridge bar and said clamp screw.

20. The tool extender according to claim 1, further comprising a V-shaped element attached to said bridge support for supporting said handle of said tool.

21. A tool extender for a portable tool having a body with a front nose portion, a handle and a trigger, said tool extender comprising:

cradle means engageable with said front nose portion of said tool body;

at least one guide rod rigidly attached to said cradle means and extending from said cradle means for positioning under said tool body;

a bridge support slidable on said at least one guide rod and adjustable toward or away from said cradle means;

a strap, constructed of a flexible material, attached to said bridge support and adjustable to engage said handle of said tool, Whereby said strap and cradle means jointly support said tool;

an elongated arm structure extending from said bridge support;

a shoulder mount attached to said elongated arm structure remote from said bridge support;

a trigger actuation mechanism extending along said elongated arm structure and having a hook engageable with said tool trigger, and a grip element proximate to said mount, said trigger actuation mechanism being operable by manual squeezing of said grip element toward said mount and away from said hook; and an adjustable handle removably attached to said elongated arm structure between said bridge support and said grip element.

22. The tool extender according to claim 21, wherein said trigger actuation mechanism further comprises:

a cord extending between said hook and said grip element to be generally parallel to said elongated arm structure; and a fastener removably attached to said cord for adjustably securing said cord at a desired length to enable remote actuation of said trigger of said tool.

23. The tool extender according to claim 21, wherein said hook includes an elongated portion engageable with said trigger of said tool for accommodating various sized tools.

24. The tool extender according to claim 21, wherein said strap includes a bra cup engageable with said handle of said tool.

25. The tool extender according to claim 21, wherein said elongated arm structure includes a first arm structure, a second arm structure, and a pivotal connection attached therebetween enabling one of said first and second arm structures to be inclined at an angle with respect to the other of said first and second arm structures.

* * * * *